US010337287B2

(12) United States Patent
Harper et al.

(10) Patent No.: US 10,337,287 B2
(45) Date of Patent: Jul. 2, 2019

(54) TUBULAR ASSEMBLY INCLUDING A SLIDING SLEEVE HAVING A DEGRADABLE LOCKING ELEMENT

(71) Applicants: Jason M. Harper, Cypress, TX (US); James G. King, Kingwood, TX (US); James Scott Sanchez, Tomball, TX (US)

(72) Inventors: Jason M. Harper, Cypress, TX (US); James G. King, Kingwood, TX (US); James Scott Sanchez, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1019 days.

(21) Appl. No.: 14/487,812

(22) Filed: Sep. 16, 2014

(65) Prior Publication Data

US 2016/0076337 A1 Mar. 17, 2016

(51) Int. Cl.

| | |
|---|---|
| ***E21B 34/14*** | (2006.01) |
| ***E21B 23/00*** | (2006.01) |
| *E21B 34/00* | (2006.01) |

(52) U.S. Cl.

CPC ..... *E21B 34/14* (2013.01); *E21B 23/004* (2013.01); *E21B 2034/007* (2013.01)

(58) Field of Classification Search

CPC ... E21B 34/14; E21B 2034/007; E21B 23/004
See application file for complete search history.

(56) References Cited

U.S. PATENT DOCUMENTS

| | | | | |
|---|---|---|---|---|
| 3,970,147 | A * | 7/1976 | Jessup | E21B 34/102 166/323 |
| 4,828,037 | A | 5/1989 | Lindsey et al. | |
| 5,709,269 | A * | 1/1998 | Head | E21B 17/06 166/120 |
| 6,834,726 | B2 * | 12/2004 | Giroux | E21B 21/103 166/320 |
| 2003/0019630 | A1 | 1/2003 | Freiheit et al. | |
| 2006/0042798 | A1 * | 3/2006 | Badalamenti | E21B 21/10 166/285 |
| 2008/0066923 | A1 * | 3/2008 | Xu | E21B 23/00 166/376 |

(Continued)

OTHER PUBLICATIONS

International Search Report dated Oct. 23, 2015 in corresponding International Application No. PCT/US2015/044949, 3 pages.

(Continued)

*Primary Examiner* — David J Bagnell
*Assistant Examiner* — Ronald R Runyan
(74) *Attorney, Agent, or Firm* — Cantor Colburn LLP

(57) ABSTRACT

A tubular assembly includes a turbular member having at least one opening, and a sleeve slidingly mounted relative to the tubular member. The sleeve is shiftable between an open configuration in which the at least one opening is exposed and a closed configuration in which the at least one opening is covered by the sleeve. A degradable locking member is mounted relative to one of the turbular and the sleeve. The degradable locking member selectively retains the sleeve in the open configuration. The degradable locking member is configured to degrade when exposed to a downhole fluid allowing the sleeve to be shifted to the closed configuration.

3 Claims, 5 Drawing Sheets

(56) References Cited

U.S. PATENT DOCUMENTS

| | | | | |
|---|---|---|---|---|
| 2009/0025940 | A1* | 1/2009 | Rytlewski | E21B 17/06 166/378 |
| 2009/0139726 | A1* | 6/2009 | Gomez | E21B 34/14 166/373 |
| 2011/0135953 | A1 | 6/2011 | Xu et al. | |
| 2011/0253383 | A1 | 10/2011 | Porter et al. | |
| 2012/0111574 | A1 | 5/2012 | Desranleau et al. | |
| 2013/0043047 | A1* | 2/2013 | Fay | E21B 23/02 166/381 |
| 2014/0246208 | A1 | 9/2014 | Themig et al. | |

OTHER PUBLICATIONS

Written Opinion of the International Search Authority dated Oct. 23, 2015 in corresponding International Application No. PCT/US2015/044949, 7 pages.

* cited by examiner

TUBULAR ASSEMBLY INCLUDING A SLIDING SLEEVE HAVING A DEGRADABLE LOCKING ELEMENT

BACKGROUND

Hydrocarbon drilling and recovery systems employ strings of tubulars that extend downhole. Often times one or more of the tubulars include openings. The openings may be selectively exposed to allow downhole fluids to pass into the string of tubulars. In some cases, a sliding sleeve is deployed to expose the openings. More specifically, the string of tubulars is positioned downhole and, at a desired time, the sliding sleeve is shifted to expose the openings. Once opened, the sleeve may be locked in place by a locking mechanism. The lock allows, for example, coiled tubing to be run downhole through the tubular without inadvertently closing the sleeve. Once locked, the sleeve may not be closed. Accordingly, improvements in sleeve locking and retaining devices are well received by the industry.

SUMMARY

A tubular assembly includes a tubular member having at least one opening, and a sleeve slidingly mounted relative to the tubular member. The sleeve is shiftable between an open configuration, in which the at least one opening is exposed, and a closed configuration, in which the at least one opening is covered by the sleeve. A degradable locking member is mounted relative to one of the tubular and the sleeve. The degradable locking member selectively retains the sleeve in the open configuration. The degradable locking member is configured to degrade when exposed to a downhole fluid allowing the sleeve to be shifted to the closed configuration.

A resource extraction system includes an uphole portion having at least a platform, a wellbore formed in a formation, and a tubular assembly extending down the wellbore into the formation. The tubular assembly includes a tubular member including at least one opening and a sleeve slidingly mounted relative to the tubular member. The sleeve is shiftable between an open configuration, in which the at least one opening is exposed, and a closed configuration, in which the at least one opening is covered by the sleeve. A degradable locking member is mounted relative to one of the tubular and the sleeve. The degradable locking member selectively retains the sleeve in the open configuration. The degradable locking member is configured to degrade when exposed to a downhole fluid allowing the sleeve to be shifted to the closed configuration.

A method of operating a downhole slidable sleeve includes running a tubular assembly including at least one tubular having one or more openings covered by a slidable sleeve into a wellbore, shifting the slidable sleeve relative to the at least one tubular from a closed configuration to an open configuration exposing the one or more openings to a downhole fluid, locking the slidable sleeve in the open configuration with a degradable locking member, and exposing the degradable locking member to a downhole fluid causing the degradable locking member to degrade.

BRIEF DESCRIPTION OF THE DRAWINGS

Referring now to the drawings wherein like elements are numbered alike in the several Figures.

DETAILED DESCRIPTION

Figure 1:
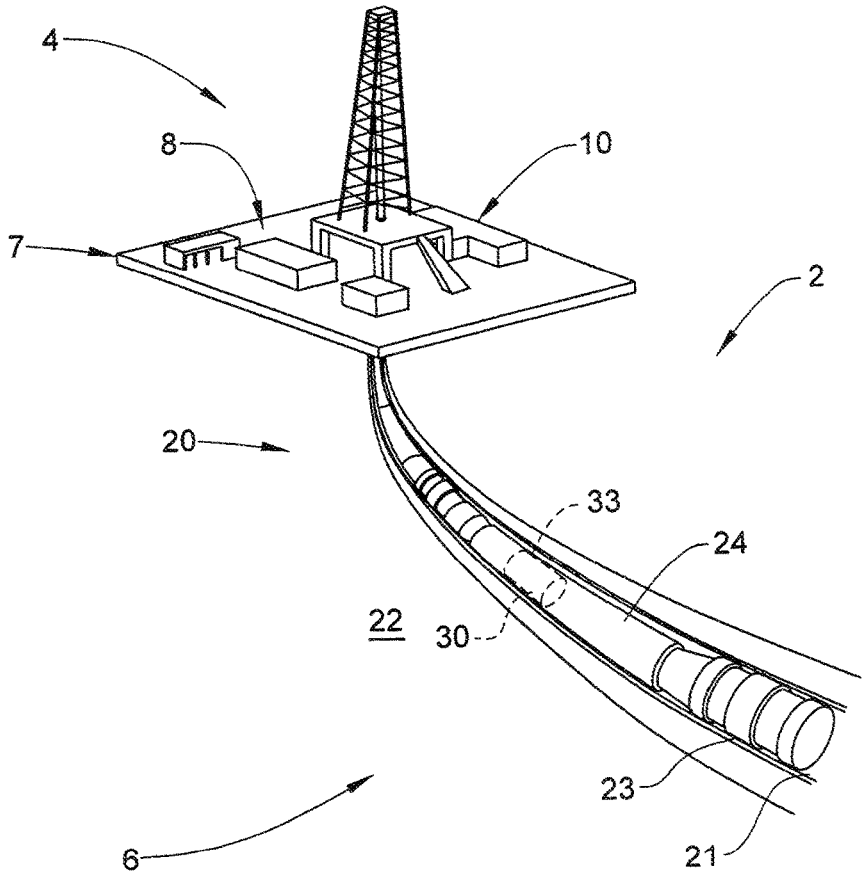
FIG. 1 depicts a resource extraction system including a tubular assembly having a slidable sleeve with a degradable locking member, in accordance with an aspect of an exemplary embodiment.
Figure 2:
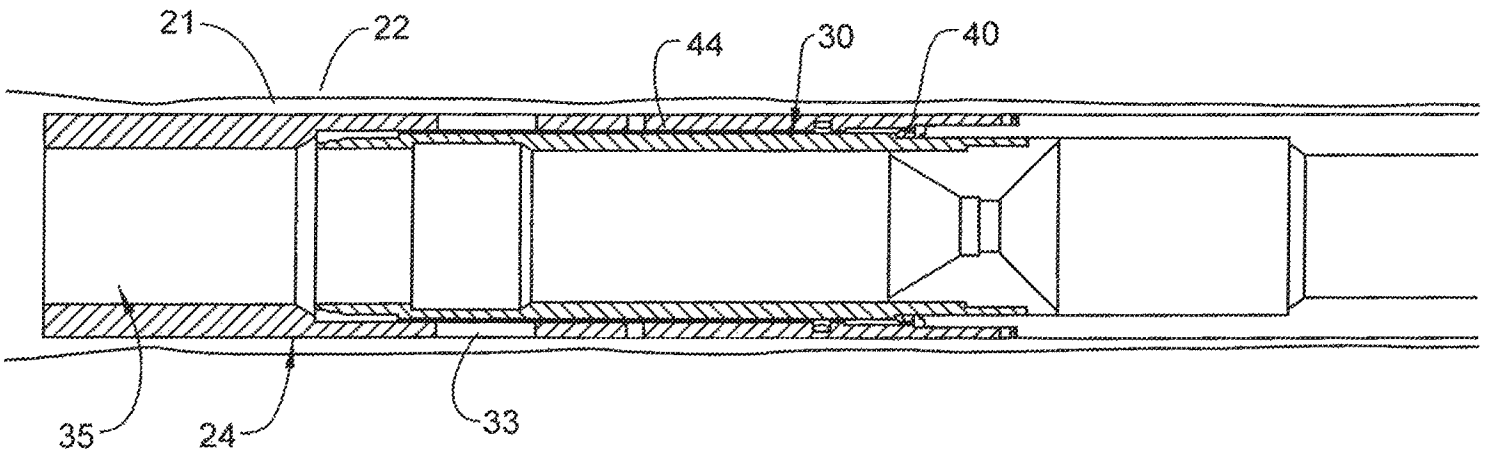
FIG. 2 depicts the tubular assembly of FIG. 1 with the slidable sleeve in a closed configuration.
Figure 3:
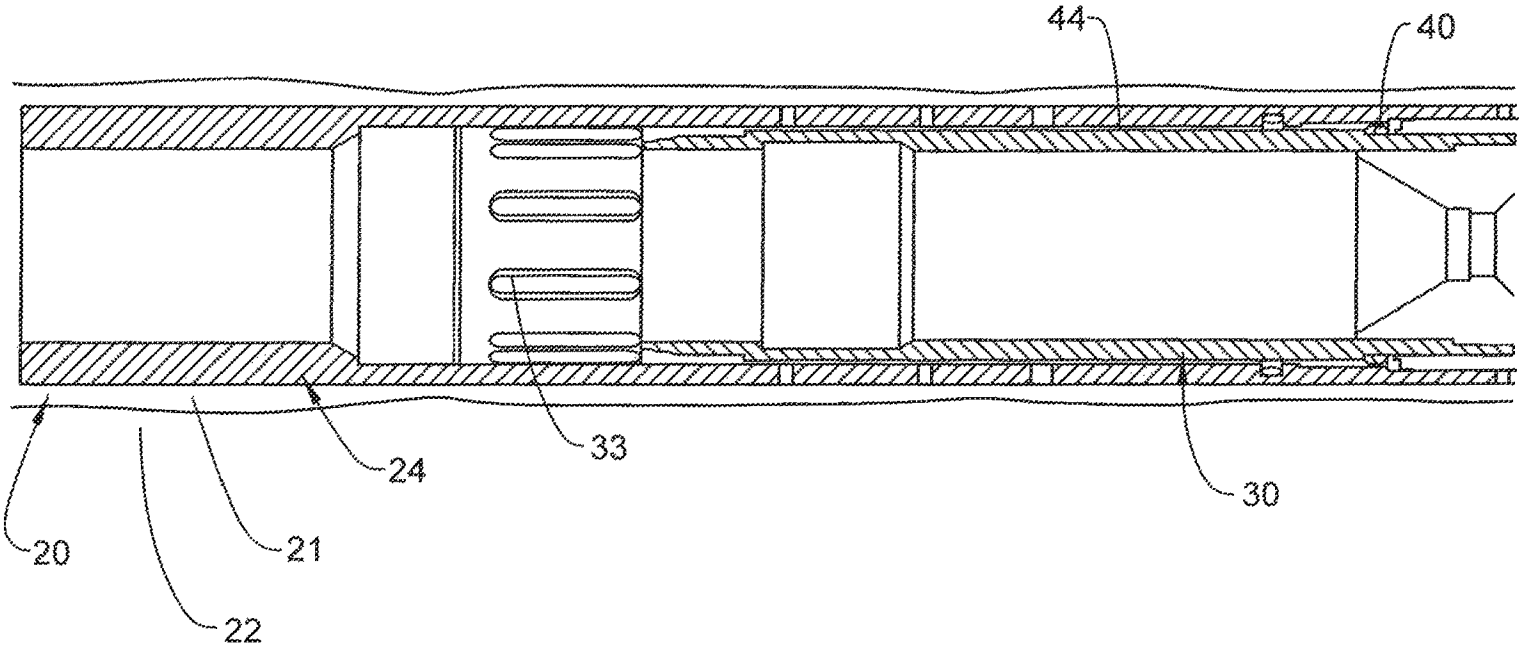
FIG. 3 depicts the tubular assembly with the slidable sleeve locked in an open configuration through the degradable locking member of FIG. 1.

A resource extraction system, in accordance with an exemplary embodiment, is indicated generally at 2, in FIG. 1. Resource extraction system 2 includes an uphole system 4 operatively connected to a downhole system 6. Uphole system 4 may include a platform 7 that supports pumps 8 that aid in completion and/or extraction processes as well as fluid storage 10. Fluid storage 10 may contain a completion fluid that is introduced into downhole system 6. Downhole system 6 may include a downhole string of tubulars 20 that is extended into a wellbore 21 formed in formation 22. A well casing 23 extends down wellbore 21 to provide stability. Downhole string of tubulars 20 may include a tubular 24 and a slidable sleeve 30. Slidable sleeve 30 may be selectively shifted from a closed configuration (FIG. 2) to an open configuration (FIG. 3) exposing a plurality of openings 33 formed in tubular 24. Openings 33 allow fluid to pass from wellbore 21 into an interior portion 35 of tubular string 20 and vice versa. In the exemplary embodiment shown, slidable sleeve 30 is arranged radially inwardly of tubular 24. However, it should be understood that the relative position of slidable sleeve 30 and tubular 24 may vary.

In accordance with an aspect of an exemplary embodiment, a degradable locking member 40 retains slidable sleeve 30 in the open configuration. In the exemplary embodiment shown, locking member 40 is positioned radially outwardly of an outer surface (not separately labeled) of slidable sleeve 30. When in the open configuration, degradable locking member 40 nests within an annular groove 44 formed in the outer surface of slidable sleeve 30. When nested within annular groove 44, slidable sleeve 30 is prevented from shifting from the open configuration. In this manner, operators may introduce components, such as various tools, coiled tubing and the like, into downhole tubular string 20 without inadvertently shifting slidable sleeve 30 to the closed configuration. In previous systems, slidable sleeve 30 was forever prevented from being closed. In accordance with the exemplary embodiment, degradable locking member 40 will, over time, mechanically and/or chemically degrade. When degraded to a particular degree, slidable sleeve 30 may be shifted against degradable locking member 40. Further shifting will cause degradable locking member 40 to release. At such time, slidable sleeve 30 may be freely shifted from the open configuration to the closed configuration.

Figure 4:
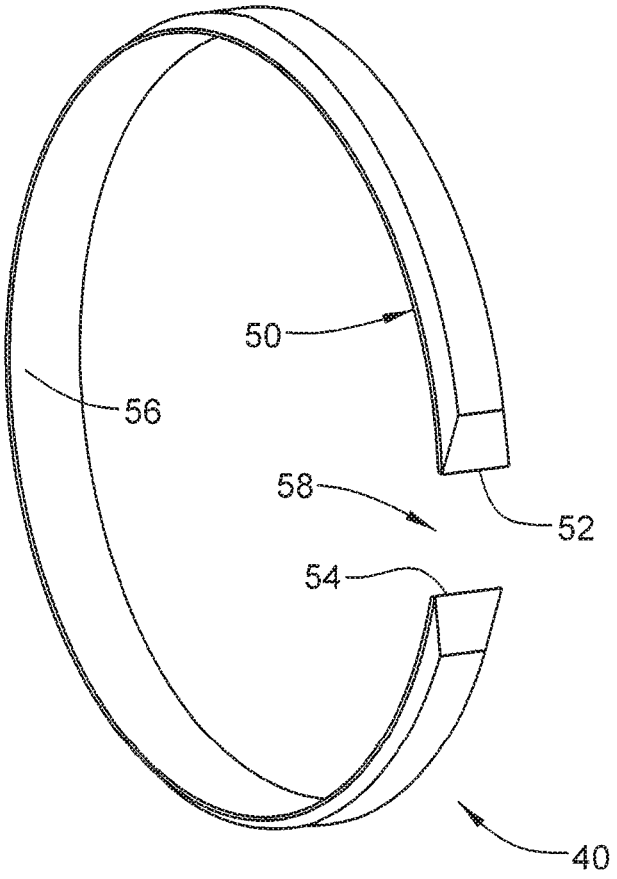
FIG. 4 depicts a degradable locking member, in accordance with an aspect of an exemplary embodiment.
Figure 5:
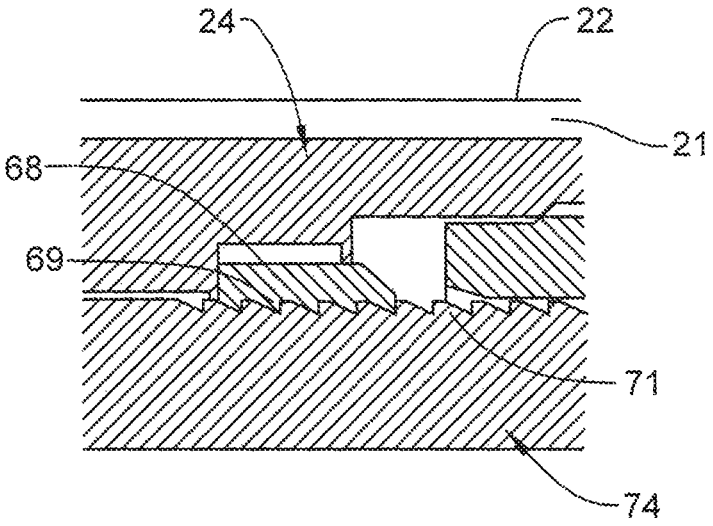
FIG. 5 depicts a degradable locking member, in accordance with another aspect of an exemplary embodiment.
Figure 6:
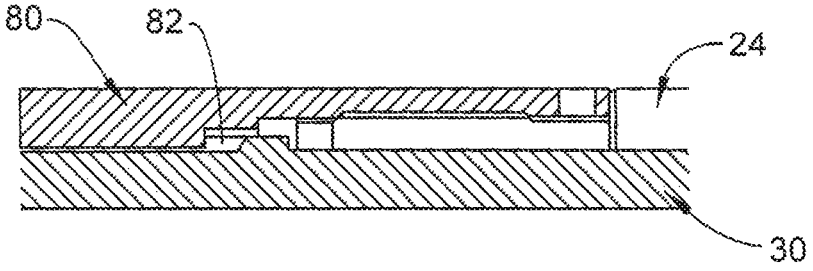
FIG. 6 depicts a degradable locking member, in accordance with yet another aspect of an exemplary embodiment.

In accordance with one aspect of an exemplary embodiment, degradable locking member 40 may take the form of a degradable snap ring 50, illustrated in FIG. 4. Degradable snap ring 50 extends from a first end 52 to a second end 54 through a degradable intermediate portion 56. First end 52 may be spaced from second end 54 defining a discontinuity 58. In accordance with another aspect of an exemplary embodiment, locking member 40 may take the form of a body lock ring 68, illustrated in FIG. 5. Body lock ring 68 may include a plurality of teeth 69 that meshingly engage with another plurality of teeth 71 formed on an outer surface (not separately labeled) of a slidable sleeve 74. In accordance with yet another aspect of an exemplary embodiment, degradable locking member 40 may take the form of a collet 80 arranged radially outwardly of tubular 24. Collet 80 includes a degradable locking portion 82 that, once degraded, allows slidable sleeve 30 to return to a closed configuration.

At this point, it should be understood that degradable locking member 40 may be formed in whole, or in part, from a material that disintegrates when exposed to downhole fluids. As will be discussed more fully below, degradable locking member 40 may be provided with a coating that may delay disintegration of degradable locking member 40 for a period of time. As will be discussed more fully below, coatings and underlying body materials may take on a variety of forms.

In accordance with an aspect of an exemplary embodiment, degradable locking member 40 may be formed from materials that are degradable by exposure to a variety of fluids capable of being pumped, present, or delivered downhole such as water, acid, oil, etc. The degradable material could be a metal, a composite, a polymer, etc., or any other material that is suitably degradable and that can withstand the loads during run-in, etc. In one embodiment, the degradable locking member 40 may be manufactured from a high strength controlled electrolytic metallic material and is degradable by brine, acid, or aqueous fluid.

That is, materials appropriate for the purpose of degradable locking member 40 described herein are lightweight, high-strength metallic materials. Examples of suitable materials, e.g., high strength controlled electrolytic metallic materials, and their methods of manufacture are given in United States Patent Publication No. 2011/0135953 (Xu, et al.), which Patent Publication is hereby incorporated by reference in its entirety. These lightweight, high-strength, selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications.

Suitable core materials include electrochemically active metals having a standard oxidation potential greater than or equal to that of Zn, including Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers may be formed from Al, Ni, W or $Al_2O_3$, or combinations thereof. In one embodiment, the coating may be a multi-layer coating, for example, comprising a first Al layer, a $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of operating a downhole slidable sleeve comprising:

running a tubular assembly including at least one tubular having one or more openings into a wellbore;

shifting a slidable sleeve carried by the at least one tubular from a first configuration to a second configuration;

locking the slidable sleeve in the second configuration with a degradable locking member after the slidable sleeve is shifted from the first configuration; and exposing the degradable locking member to a downhole fluid causing the degradable locking member to degrade.

2. The method of claim 1, further comprising: shifting the slidable sleeve from the second configuration back to the first configuration.

3. The method of claim 1, wherein shifting the slidable sleeve from the first configuration to the second configuration comprises shifting the slidable sleeve from a closed configuration to an open configuration.

* * * * *